US008480260B2

(12) United States Patent
Quadri et al.

(10) Patent No.: US 8,480,260 B2
(45) Date of Patent: Jul. 9, 2013

(54) STAGE LIGHT FITTING FOR MAKING LIGHT EFFECTS

(75) Inventors: Pasquale Quadri, Torre De' Roveri (IT); Angelo Cavenati, Brusaporto (IT)

(73) Assignee: Clay Paky S.p.A., Seriate (IT)

( * ) Notice: Subject to any disclaimer, the term of this patent is extended or adjusted under 35 U.S.C. 154(b) by 455 days.

(21) Appl. No.: 12/732,317

(22) Filed: Mar. 26, 2010

(65) Prior Publication Data

US 2010/0246184 A1 Sep. 30, 2010

(30) Foreign Application Priority Data

Mar. 27, 2009 (IT) ..... MI2009A0492

(51) Int. Cl.
*F21V 9/00* (2006.01)
*F21V 5/02* (2006.01)

(52) U.S. Cl.
USPC ..... 362/293; 362/339; 362/281; 362/322

(58) Field of Classification Search
USPC ..... 362/293, 281, 339, 322, 620; 353/81, 353/101
See application file for complete search history.

(56) References Cited

U.S. PATENT DOCUMENTS

| | | | | |
|---|---|---|---|---|
| 5,067,064 | A * | 11/1991 | Gehly et al. | 362/277 |
| 5,515,254 | A | 5/1996 | Smith et al. | |
| 5,608,580 | A * | 3/1997 | Quadri | 359/831 |
| 6,502,961 | B1 * | 1/2003 | Richardson | 362/268 |
| 7,483,220 | B2 * | 1/2009 | Kittelmann et al. | 359/742 |
| 7,645,058 | B2 * | 1/2010 | Kurokawa et al. | 362/339 |
| 7,887,219 | B2 * | 2/2011 | Belliveau et al. | 362/268 |
| 2003/0218881 | A1 * | 11/2003 | Hansen et al. | 362/293 |
| 2006/0126336 | A1 * | 6/2006 | Solomon | 362/277 |

FOREIGN PATENT DOCUMENTS

| | | | |
|---|---|---|---|
| EP | 0674202 | 9/1995 | |
| EP | 0961136 | 12/1999 | |
| EP | 0965788 | 12/1999 | |
| WO | WO 2005/083475 | * 9/2005 | 362/339 |
| WO | WO 2007/122459 | 11/2007 | |

* cited by examiner

*Primary Examiner* — Peggy A. Neils
(74) *Attorney, Agent, or Firm* — Leason Ellis LLP

(57) ABSTRACT

A stage light fitting for making light effects has a light source adapted to generate a light beam extending along an axis; a main optical assembly; and at least one filter for shaping the light beam; wherein the filter is arranged between the light source and the main optical assembly, is adapted to selectively intercept the light beam, and has a multi-faceted face defined by a plurality of adjacent cavities.

28 Claims, 4 Drawing Sheets

STAGE LIGHT FITTING FOR MAKING LIGHT EFFECTS

The present invention relates to a stage light fitting for making light effects.

In particular, the present invention relates to a stage light fitting comprising a light source adapted to generate a light beam extending along an axis; a main optical assembly arranged along the axis; and a filter arranged between the light source and the main optical assembly and adapted to selectively intercept the light beam along the axis.

BACKGROUND OF THE INVENTION

Stage light fittings are basically grouped into two types called "wash" and "spot", respectively. Light fittings of "wash" type are characterized in that they project a light beam of diffused light, while light fittings of "spot" type are characterized in that they project concentrated light beams, and are capable of focusing images projected onto a surface hit by the light beam.

From a structural point of view, light fittings of "spot" type differ from light fittings of "wash" type due to the respective main optical assemblies: stage light fittings of "wash" type employ a main optical assembly including a Fresnel lens or more generally a plano-convex lens with the flat surface being milled or opacified, while the light fittings of "spot" type employ a main optical assembly comprising an objective lens and capable of focusing the projected images. Both the above-identified types of stage light fittings may be equipped with a plurality of optical devices arranged between the light source and the main optical assembly so as to produce light effects. Among the optical devices which are arranged between the light source and the main optical assembly, it is worth recalling the filters which, in turn, are grouped into coloured filters and filters adapted to shape the light beam, also known as "beam shapers"; the prisms adapted to divide the light beam emitted by the light source into two or more outgoing light beams, the shutters to shape the light beam; the gobo devices; the dimmers, etc.

The above-identified optical devices permit to obtain a plurality of light effects even considering that the stage light fittings are designed to intercept the light beam by means of one or more optical devices so as to combine the respective light effects. Although the stage light fittings available on the market offer the possibility of obtaining a plurality of light effects, the light designers, i.e. those who study and design light performances, are always looking for new possible light effects and combinations of light effects.

SUMMARY OF THE INVENTION

In light of the above, it is one of the objects of the present invention to provide a stage light fitting capable of shaping a light beam in a simple and cost-effective manner.

In particular, it is the object of the present invention to shape the light beam without employing shutters and in a simple, reliable manner.

According to the present invention, a stage light fitting for making light effects is provided, the stage light fitting comprising a light source adapted to generate a light beam extending along a first axis; a main optical assembly; and at least one filter for shaping the light beam; where the filter is arranged between the light source and the main optical assembly, it is adapted to selectively intercept the light beam, and has a multi-faceted face defined by a plurality of adjacent cavities.

Thereby, the filter concentrates the light beam thus producing light effects according to the shape and distribution of the cavities. Moreover, the filter provided in accordance with the present invention is resistant, simple and particularly cost-effective.

BRIEF DESCRIPTION OF THE DRAWINGS

Further features and advantages of the present invention will become more apparent from the following description of a non-limiting embodiment thereof, with reference to the figures of the accompanying drawings, in which.

DETAILED DESCRIPTION OF THE INVENTION

Figure 1:
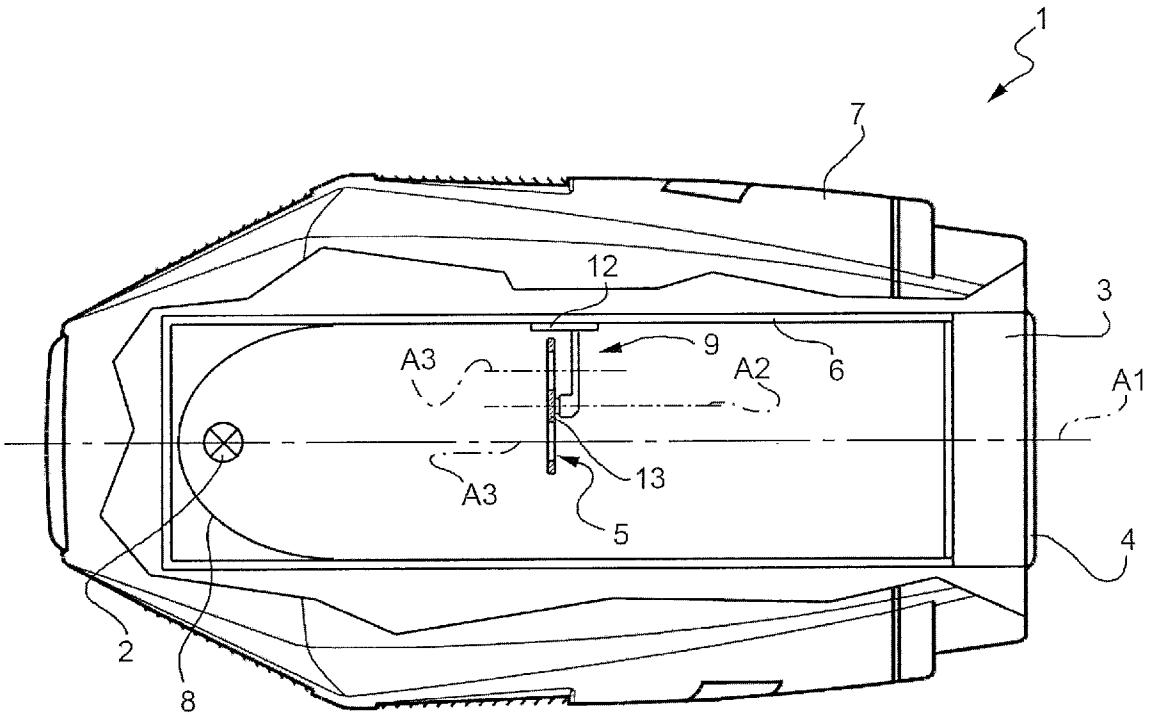
FIG. 1 is a diagrammatic, side elevation view with parts removed for clarity, of a stage light fitting provided according to the invention.

With reference to FIG. 1, numeral 1 indicates a stage light fitting comprising a light source 2 adapted to generate a light beam extending along an axis A1; a main optical assembly 3 comprising at least a main lens 4; and a filter 5 arranged between the light source 2 and the main optical assembly 3 and adapted to selectively intercept the light beam along axis A1.

Figure 2:
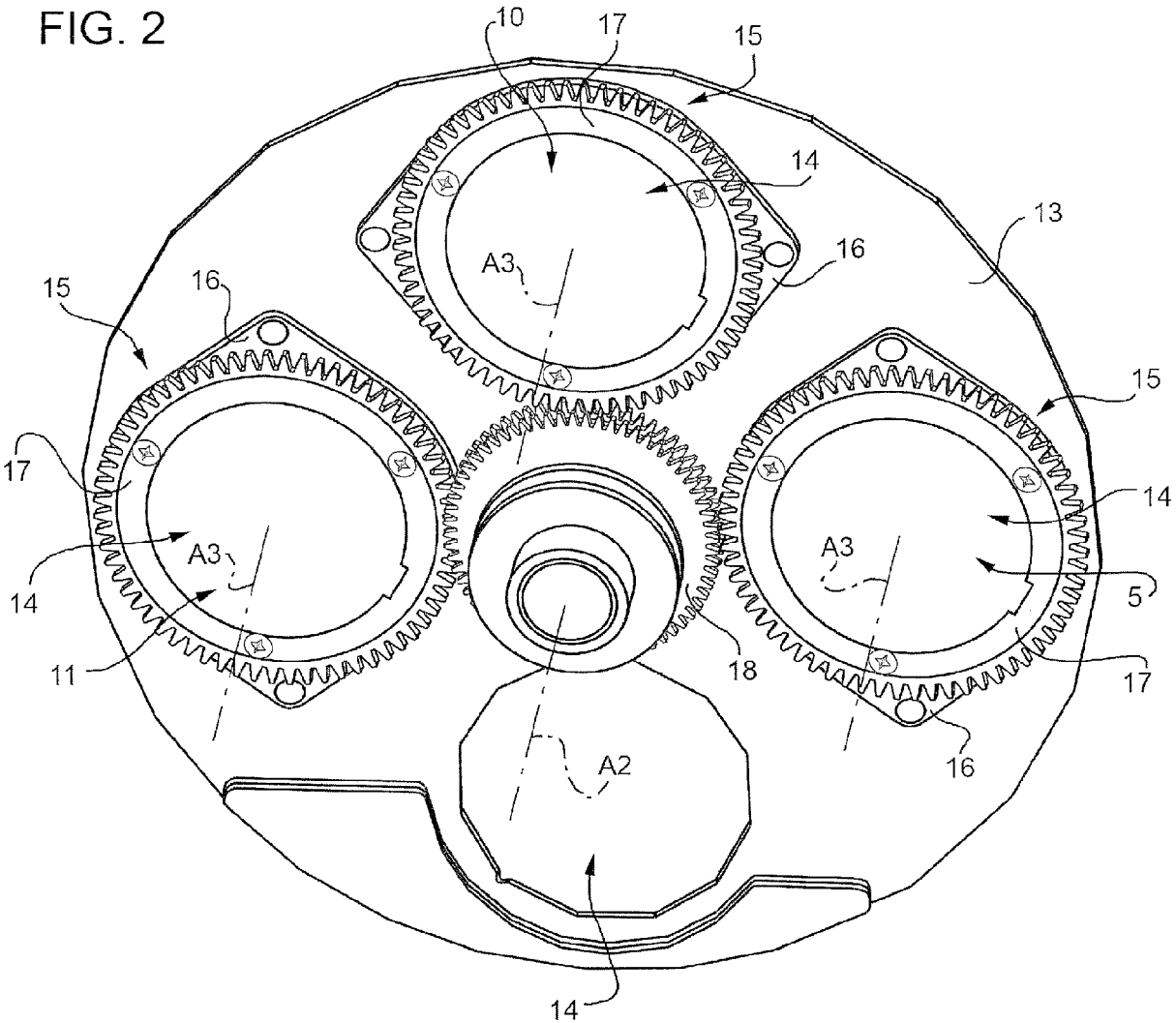
FIG. 2 is a perspective view, with parts removed for clarity and on enlarged scale, of a detail of the stage light fitting in FIG. 1.

The stage light fitting 1 comprises a frame 6, an external housing 7, a parabolic reflector 8 to direct the light beam along axis A1 and an optical device 9 adapted to support filter 5 and other filters 10 and 11 as better shown in FIG. 2.

The optical device 9 comprises a trolley 12 selectively mobile in a direction parallel to axis A1 with respect to frame 6 and a wheel 13 mounted in a rotatable manner with respect to trolley 12 about an axis A2 parallel to axis A1.

With reference to FIG. 2, wheel 13 comprises seats 14 uniformly distributed about axis A2 and adapted to house the filters 5, 10 and 11. The rotation of wheel 12 about axis A2 serves the function of selectively arranging one of filters 5, 10, 11 along axis A1 so as to intercept the light beam with one of the filters 5, 10 and 11. One of the seats 14 is not engaged by one of the filters 5, 10 and 11 so as to be able to arrange wheel 13 in an operating position in which the light beam is not intercepted by filters 5, 10 and 11.

Each of the filters 5, 10, 11 is mounted in a bearing 15 having a ring 16 adapted to be fixed to the wheel 13 inside a respective seat 14, and a toothed ring 17 rotatable about a third axis A3 with respect to the ring 16. In essence, filters 5, 10, and 11 are circular discs of axis A3, integral with the toothed ring 17. The rotation of wheel 13 about axis A2 serves the function of arranging axis A3 of one of the filters 5, 10 and 11 substantially in alignment with axis A1, as better shown in FIG. 1.

The optical device 9 comprises a toothed wheel 18 of axis A2 engaged with all toothed rings 17 so as to rotate the filters 5, 10, 11 about the respective axes A3.

With reference to FIG. 1, the optical device 9 is equipped with independent motorizations not shown in the accompanying figures and adapted to carry out the translation of the trolley 12 parallel to axis A1, the rotation of the wheel 13 about axis A2, and the rotation of the filters 5, 10, and 11 about axis A3.

Figure 3:
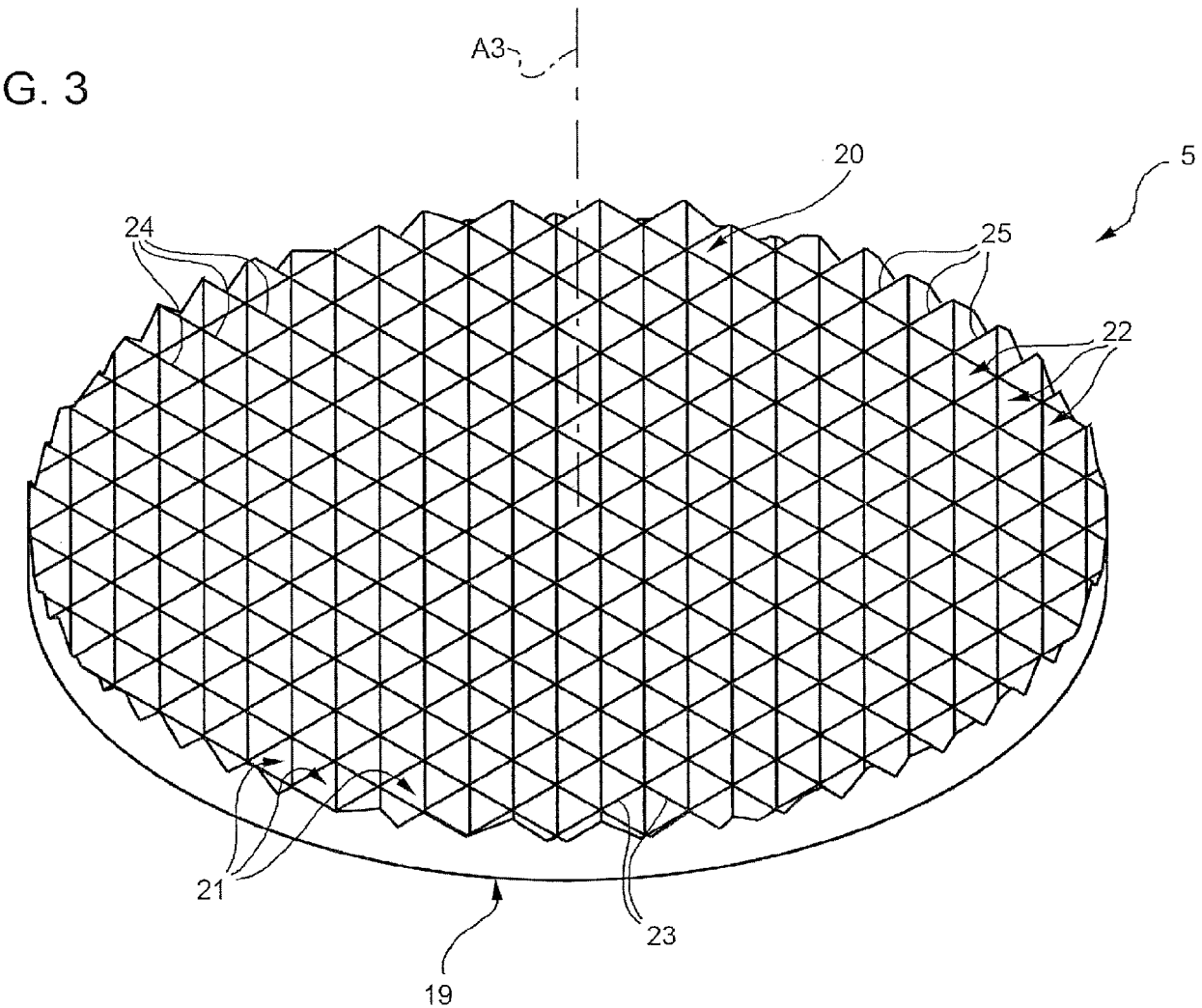
FIG. 3 is a perspective view, with parts removed for clarity and on further enlarged scale, of a filter of the stage light fitting in FIG. 1.

With reference to FIG. 3, filter 5 is a glass disc having a flat face 19 perpendicular to axis A3, and a multi-faceted face 20 defined by a plurality of cavities 21 adjacent to one another.

In particular, the cavities 21 are pyramid-shaped and are equal to one another and comprise faces 22, each of which has the shape of an inclined triangle with respect to axis A3. Since axis A3 is parallel to axis A1 (FIG. 1), the geometric references described with reference to axis A3 are also valid for axis A1.

Each cavity 21 has the shape of a pyramid with a square base, and has four sides 23 towards each of which two faces 22 converge.

Figure 4:
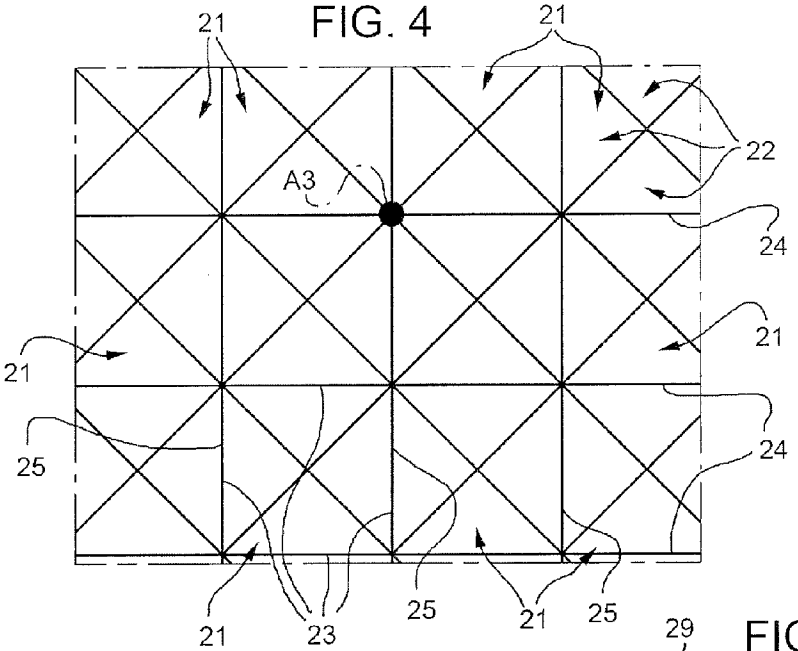
FIG. 4 is a front elevation view, with parts removed for clarity and on further enlarged scale, of the filter in FIG. 3.

In particular and with reference to FIG. 4, sides 23 of cavities 21 form edges 24 parallel to one another and transversal to axis A3, and edges 25 parallel to one another and perpendicular to edges 24 and transversal to axis A3. When filter 5 intercepts the light beam, filter 5 concentrates the light beam and deforms the light beam so that it takes on a substantially cross-like shape.

It is apparent that when filter 5 is installed in a stage light fitting of "spot" type, the cross-like shape will be sharper, while when filter 5 is installed in a stage light fitting of "wash" type, the cross-like shape will be more out of focus and diffused just in virtue of the light beam with diffused light emitted by the light fittings of "wash" type.

It is further apparent that the stage light fitting 1 may be equipped with several devices adapted to intercept the light beam to obtain several light effects and combinations of light effects.

Figure 5:
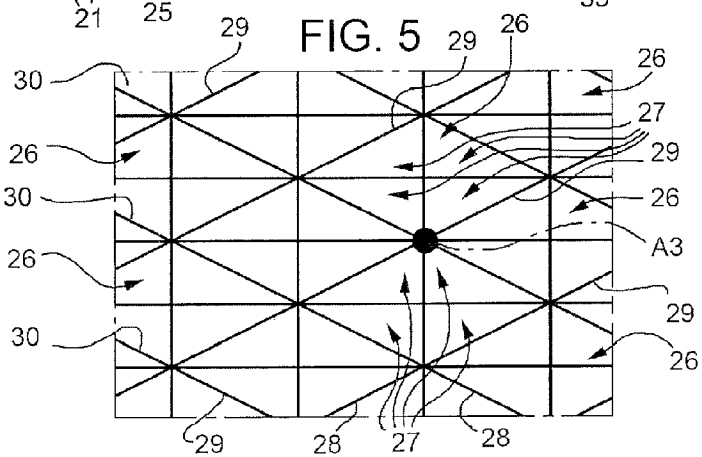
FIG. 5 is a front elevation view on enlarged scale, of a variant of the filter in FIGS. 3 and 4.

With reference to the variant in FIG. 5, the multi-faceted face 20 of filter 5 is defined by a plurality of cavities 26, which are pyramid-shaped, are equal to one another, and comprise faces 27, each of which has the shape of an inclined triangle with respect to axis A3.

Each cavity 26 has the shape of a pyramid with a diamond-shaped base and has four sides 28 towards each of which two faces 27 of two adjacent cavities 26 converge to form an edge 29 or 30.

In particular, sides 28 of cavities 21 form edges 29 parallel to one another and transversal to axis A3, and edges 30 parallel to one another and inclined with respect to edges 29 and transversal to axis A3.

When filter 5 intercepts the light beam, filter 5 concentrates and deforms the light beam so that it takes on a substantially cross-like shape with inclined arms according to the angle formed by the sides of the diamond.

Figure 6:
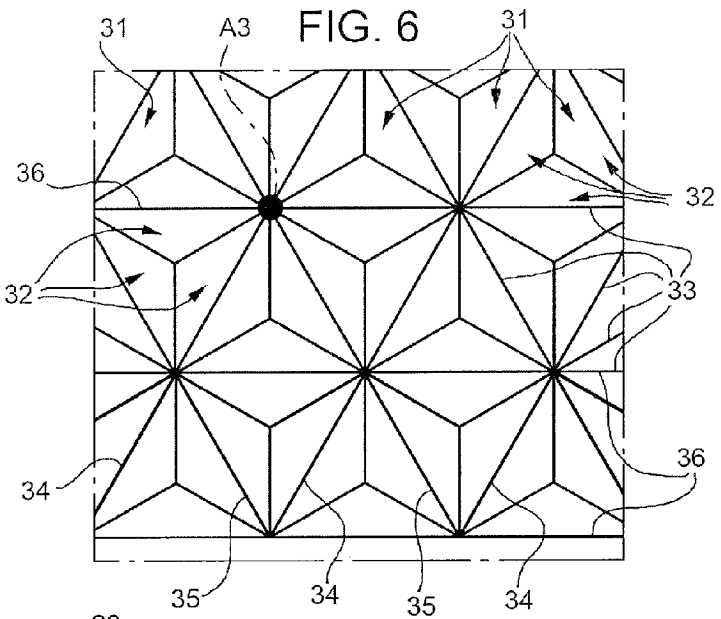
FIG. 6 is a front elevation view on enlarged scale, of a further variant of the filter in FIGS. 3 and 4.

With reference to the variant in FIG. 6, the multi-faceted face 20 of filter 5 is defined by a plurality of cavities 31, which are pyramid-shaped, are equal to one another, and comprise faces 32, each of which has the shape of an inclined triangle with respect to axis A3.

Each cavity 31 has the shape of a pyramid with an isosceles triangle-shaped base and has four sides 33 towards each of which two faces 32 of two adjacent cavities 31 converge to form an edge 34 or 35 or 36.

In particular, the sides 33 of cavities 31 form edges 34 parallel to one another and transversal to axis A3; edges 35 parallel to one another and inclined with respect to edges 34, and transversal to axis A3; and edges 36 parallel to one another and inclined with respect to edges 34 and 35, and transversal to axis A3.

When filter 5 intercepts the light beam, filter 5 concentrates the emission and deforms the light beam so that it takes on a substantially six-pointed star shape.

It is further apparent that said cavities may take on other shapes than those described, e.g. the base of the cavities could be different from the shapes described and take on the shape of any geometrical figure without however departing from the scope of the appended claims.

The invention claimed is:

1. A stage light fitting for making light effects, the stage light fitting comprising a light source for generating a light beam extending along a first axis; a main optical assembly; and at least one filter for shaping the light beam; wherein the filter is located between the light source and the main optical assembly, is suitable for selectively intercepting the light beam, and has a multi-faceted face defined by a plurality of adjacent cavities for concentrating and deforming the light beam, wherein each cavity is delimited by sides, which form first straight edges, parallel to one another, and transversal to the first axis and second straight edges parallel to one another and transversal to the first straight edges and to the first axis.

2. The stage light fitting as claimed in claim 1, wherein the cavities have lateral faces.

3. The stage light fitting as claimed in claim 2, wherein each lateral face is a flat face having preferably the shape of a triangle.

4. The stage light fitting as claimed in claim 2, wherein each lateral face is inclined with respect to the first axis.

5. The stage light fitting as claimed in claim 1, wherein the cavities are equal to one another.

6. The stage light fitting as claimed in claim 1, wherein each cavity has a side in common with an adjacent cavity.

7. The stage light fitting as claimed in claim 1, wherein the first straight edges and the second straight edges are evenly distributed along the multi-faceted face of the filter.

8. The stage light fitting as claimed in claim 1, wherein the sides of the cavities form third straight edges, parallel to one another, and transversal to the first axis and to the first and second e straight edges.

9. The stage light fitting as claimed in claim 1, wherein the first straight edges are perpendicular to the second straight edges.

10. The stage light fitting as claimed in claim 1, wherein the filter is a disc of transparent material.

11. The stage light fitting as claimed in claim 1, wherein the filter is made of glass.

12. The stage light fitting as claimed in claim 1, wherein the filter is mounted in one optical device in a rotatable manner about a second axis parallel and offset with respect to the first axis.

13. The stage light fitting as claimed in claim 1, wherein the filter has the shape of disc extending about a third axis parallel to the first axis, and is mounted on one wheel in a rotatable manner about the third axis.

14. The stage light fitting as claimed in claim 1, comprising a frame, wherein the filter is mounted to the frame in a mobile manner in a direction parallel to the first axis.

15. A stage light fitting filter for shaping a light beam that extends along a first axis and for placement between a light source that generates the light beam and a main optical assembly, the filter being configured for selectively intercepting the light beam, and wherein the filter has a multi-faceted face defined by a plurality of adjacent cavities for concentrating and deforming the light beam, wherein each cavity is delimited by sides, which form first straight edges, parallel to one another, and transversal to the first axis and second straight edges parallel to one another and transversal to the first straight edges and to the first axis.

16. The filter as claimed in claim 15, wherein the cavities have lateral faces.

17. The filter as claimed in claim 16, wherein each lateral face is a flat face having preferably the shape of a triangle.

18. The filter as claimed in claim 16, wherein each lateral face is inclined with respect to the first axis.

19. The filter as claimed in claim 15, wherein the cavities are equal to one another.

20. The filter as claimed in claim 15, wherein each cavity has a side in common with an adjacent cavity.

21. The filter as claimed in claim 15, wherein the first straight edges and the second straight edges are evenly distributed along the multi-faceted face of the filter.

22. The filter as claimed in claim 15, wherein the sides of the cavities form third straight edges, parallel to one another, and transversal to the first axis and to the first and second straight edges.

23. The filter as claimed in claim 15, wherein the first straight edges are perpendicular to the second straight edges.

24. The filter as claimed in claim 15, wherein the filter is a disc of transparent material.

25. The stage light fitting as claimed in claim 15, wherein the filter is made of glass.

26. The filter as claimed in claim 15, wherein the filter is configured to be mounted in one optical device in a rotatable manner about a second axis parallel and offset with respect to the first axis.

27. The filter as claimed in claim 15, wherein the filter has the shape of disc extending about a third axis parallel to the first axis, and is configured to be mounted on one wheel in a rotatable manner about the third axis.

28. The filter as claimed in claim 15, further comprising a frame, wherein the filter is configured to be mounted to the frame in a mobile manner in a direction parallel to the first axis.

* * * * *